US009869954B2

(12) United States Patent
Saito

(10) Patent No.: US 9,869,954 B2
(45) Date of Patent: Jan. 16, 2018

(54) FIXING DEVICE FOR IMAGE FORMING APPARATUS

(71) Applicant: Konica Minolta, Inc., Tokyo (JP)

(72) Inventor: Masashi Saito, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/265,319

(22) Filed: Sep. 14, 2016

(65) Prior Publication Data

US 2017/0082961 A1 Mar. 23, 2017

(30) Foreign Application Priority Data

Sep. 18, 2015 (JP) ..... 2015-184899

(51) Int. Cl.
*G03G 15/00* (2006.01)
*G03G 15/20* (2006.01)

(52) U.S. Cl.
CPC . *G03G 15/2032* (2013.01); *G03G 2215/2032* (2013.01)

(58) Field of Classification Search
CPC ... G03G 2215/2035; G03G 2215/2032; G03G 15/2064; G03G 15/2053; G03G 15/2039
See application file for complete search history.

(56) References Cited

U.S. PATENT DOCUMENTS

2009/0311015 A1* 12/2009 Nakayama ..... G03G 15/2025 399/327
2013/0272736 A1* 10/2013 Sakamaki ..... G03G 15/205 399/67
2015/0198920 A1* 7/2015 Fukuhata ..... G03G 15/2064 399/329

FOREIGN PATENT DOCUMENTS

JP 2005215580 A 8/2005
JP 2015028582 A 2/2015

* cited by examiner

*Primary Examiner* — Walter L Lindsay, Jr.
*Assistant Examiner* — Jessica L Eley
(74) *Attorney, Agent, or Firm* — Lucas & Mercanti, LLP

(57) ABSTRACT

A fixing device includes: a fixing side member; a fixing belt; a back side supporting member configured to form a fixing nip for conveying the recording medium in a tightly sandwiching manner; a heating roller configured to heat the fixing belt from inside; a first movement section configured to move the fixing side member between a first pressure contact position where the fixing side member is brought into pressure contact with the back side supporting member with the fixing belt therebetween, and a second pressure contact position where the fixing side member is brought into pressure contact with the heating roller; and a control section configured to control the first movement section to move the fixing side member to the first pressure contact position in a printing operation, and move the fixing side member to the second pressure contact position when the printing operation is not performed.

20 Claims, 5 Drawing Sheets

FIXING DEVICE FOR IMAGE FORMING APPARATUS

CROSS REFERENCE TO RELATED APPLICATIONS

This application is entitled to and claims the benefit of Japanese Patent Application No. 2015-184899, filed on Sep. 18, 2015, the disclosure of which including the specification, drawings and abstract is incorporated herein by reference in its entirety.

BACKGROUND OF THE INVENTION

1. Field of the Invention

The present invention relates to a fixing device, an image forming apparatus, and a computer-readable recording medium storing a program.

2. Description of Related Art

As an example of conventional fixing devices used for an electrophotographic image forming apparatus such as a copier, a printer, and a FAX, a fixing device (of heat roller type) has been known which includes a heating roller having a rubber layer at a surface layer and a heat source provided inside, and a pressure roller which makes pressure contact with the heating roller. In this fixing device, in a printing operation, a toner receiving article (for example, recording paper) on which an unfixed toner image is formed is conveyed and heated by sandwiching the toner receiving article between the rollers to fix the toner image on the recording paper.

In addition, for example, a belt type fixing device is known which includes a heating roller having a heat source provided inside, an upper pressure roller, a thin endless belt wound around the rollers (hereinafter referred to as "fixing belt"), and a lower pressure roller which makes pressure contact with the upper pressure roller. In this belt type fixing device, in the printing operation, a recording sheet is conveyed by sandwiching the sheet between the upper and lower pressure rollers while heating the sheet through the fixing belt to fix the toner image on the recording sheet. In the belt type fixing device, the heat value which is consumed when heating the thin fixing belt is smaller than the heat value which is consumed when heating a rubber layer having a small thermal conductivity in heat roller type fixing devices. In view of this, the belt type fixing device is advantageous in terms of energy saving.

Incidentally, when the upper pressure roller is cold in the printing operation, the heat value is insufficient in the case where the heat value of the fixing belt heated by the heating roller is used not only for melting a toner on the recording paper at the fixing nip but also for heating the upper pressure roller and a plurality of sheets are printed. As a result, the fixing temperature required for fixing the toner image may not be obtained, and fixation failure may be caused. In view of this, in the operations other than the printing operation such as the warming-up operation after power is switched on and the standby mode before the printing, the upper pressure roller is always or intermittently rotated, and the heat value of the fixing belt heated by the heating roller is used for warming-up of the upper pressure roller.

However, since the upper pressure roller is in pressure contact with the lower pressure roller, the lower pressure roller removes the heat for warming-up from the upper pressure roller, and the lower pressure roller is heated. In this manner, the heat value is wastefully consumed. In addition, when the heat for warming-up is removed and the heat value of the upper pressure roller becomes insufficient, the fixing temperature may not be obtained, and fixation failure may be caused.

Japanese Patent Application Laid-Open No. 2005-215580 discloses a technique in which, in the standby mode, the lower pressure roller is released, and is not allowed to make pressure contact with the upper pressure roller.

At the time of warming-up of the upper pressure roller, by preventing the lower pressure roller from making pressure contact with the upper pressure roller as the technique disclosed in Japanese Patent Application Laid-Open No. 2005-215580, the heat for warming-up is not removed by the lower pressure roller, and the heat value of the upper pressure roller does not become insufficient. Consequently, stable fixation performance can be achieved without reducing the fixing temperature. However, even when the lower pressure roller is prevented from making pressure contact with the upper pressure roller, the upper pressure roller is heated through the fixing belt heated by the heating roller, and as a result the efficiency of the warming-up of the upper pressure roller is disadvantageously reduced.

SUMMARY OF THE INVENTION

An object of the present invention is to provide a fixing device, an image forming apparatus, and a computer-readable recording medium storing a program which can prevent the fixation failure while improving the efficiency of warming-up of the fixing side member.

To achieve the abovementioned object, a fixing device reflecting one aspect of the present invention includes: a fixing side member disposed on a fixing side of a recording medium on which a toner image is formed; a fixing belt wound around the fixing side member; a back side supporting member configured to form a fixing nip for conveying the recording medium in a tightly sandwiching manner in a state where the back side supporting member is in pressure contact with the fixing side member with the fixing belt therebetween; a heating roller configured to heat the fixing belt from inside, the heating roller being rotatable; a first movement section configured to move the fixing side member between a first pressure contact position where the fixing side member is brought into pressure contact with the back side supporting member with the fixing belt therebetween, and a second pressure contact position where the fixing side member is brought into pressure contact with the heating roller; and a control section configured to control the first movement section to move the fixing side member to the first pressure contact position in a printing operation, and move the fixing side member to the second pressure contact position when the printing operation is not performed.

Desirably, in the fixing device, the heating roller is configured such that the fixing belt rotates along with rotation of the heating roller when the heating roller rotates in the printing operation, and that, when the printing operation is not performed, the fixing belt slips on the heating roller which is rotated.

Desirably, in the fixing device, a coefficient of friction of the heating roller on the fixing belt is set such that the fixing belt rotates along with the rotation of the heating roller in a first direction in the printing operation, and that the fixing belt slips on the heating roller which is rotated in a second direction opposite to the first direction when the printing operation is not performed.

Desirably, the fixing device further includes: a supporting member configured to support the fixing belt from inside; and a second movement section configured to move the supporting member, wherein, when the printing operation is not performed, the control section controls the second movement section to move the supporting member in a direction in which a slacked portion of the fixing belt is separated from the fixing nip, the slacked portion of the fixing belt being a portion slacked by movement of the fixing side member to the second pressure contact position in comparison with a state where the printing operation is performed.

Desirably, the fixing device further includes a third movement section configured to move the back side supporting member between a nip formation position where the fixing nip is formed and a non-nip formation position where the fixing nip is not formed, wherein the control section controls the third movement section to move the back side supporting member to the nip formation position in the printing operation and to move the back side supporting member to the non-nip formation position when the printing operation is not performed.

Desirably, in the fixing device, the recording medium is a continuous sheet.

Desirably, in the fixing device, further includes a fixing belt driving roller; and a fourth movement section configured to move the fixing belt driving roller between a separation position where the fixing belt driving roller is separated from the fixing belt and a contact position where the fixing belt driving roller is brought into contact with the fixing belt and rotated to rotate the fixing belt, wherein the control section controls the fourth movement section to move the fixing belt driving roller to the separation position in the printing operation and move the fixing belt driving roller to the contact position when the printing operation is not performed.

Desirably, in the fixing device, the control section controls the fourth movement section such that a rotational speed of the fixing belt when the printing operation is not performed is lower than a rotational speed of the heating roller in the printing operation.

Desirably, in the fixing device, the fixing side member rotates along with rotation of the heating roller in the printing operation.

An image forming apparatus desirably includes the above-mentioned fixing device.

To achieve the abovementioned object, in a computer-readable recording medium storing a program of a fixing device reflecting one aspect of the present invention, the fixing device including: a fixing side member disposed on a fixing side of a recording medium on which a toner image is formed; a fixing belt wound around the fixing side member; a back side supporting member configured to form a fixing nip for conveying the recording medium in a tightly sandwiching manner in a state where the back side supporting member is in pressure contact with the fixing side member with the fixing belt therebetween; a heating roller configured to heat the fixing belt from inside, the heating roller being rotatable; and a first movement section configured to move the fixing side member between a first pressure contact position where the fixing side member is brought into pressure contact with the back side supporting member with the fixing belt therebetween, and a second pressure contact position where the fixing side member is brought into pressure contact with the heating roller, the program comprising: moving the fixing side member to the first pressure contact position to bring the fixing side member into pressure contact with the back side supporting member with the fixing belt therebetween in the printing operation, and moving the fixing side member to the second pressure contact position to bring the fixing side member into pressure contact with the heating roller when the printing operation is not performed.

Desirably, in the computer-readable recording medium storing a program, the heating roller is configured such that the fixing belt rotates along with rotation of the heating roller when the heating roller rotates in the printing operation, and that, when the printing operation is not performed, the fixing belt slips on the heating roller which is rotated.

Desirably, in the computer-readable recording medium storing a program, a coefficient of friction of the heating roller on the fixing belt is set such that the fixing belt rotates along with the rotation of the heating roller in a first direction in the printing operation, and that the fixing belt slips on the heating roller which is rotated in a second direction opposite to the first direction when the printing operation is not performed.

Desirably, in the computer-readable recording medium storing a program, the fixing device further includes: a supporting member configured to support the fixing belt from inside; and a second movement section configured to move the supporting member, and, when the printing operation is not performed, the control section controls the second movement section to move the supporting member in a direction in which a slacked portion of the fixing belt is separated from the fixing nip, the slacked portion of the fixing belt being a portion slacked by movement of the fixing side member to the second pressure contact position in comparison with a state where the printing operation is performed.

Desirably, in the computer-readable recording medium storing a program, the fixing device further includes a third movement section configured to move the back side supporting member between a nip formation position where the fixing nip is formed and a non-nip formation position where the fixing nip is not formed; and the control section controls the third movement section to move the back side supporting member to the nip formation position in the printing operation and to move the back side supporting member to the non-nip formation position when the printing operation is not performed.

Desirably, in the computer-readable recording medium storing a program, the recording medium is a continuous sheet.

Desirably, in the computer-readable recording medium storing a program, the fixing device further includes a fixing belt driving roller, and a fourth movement section configured to move the fixing belt driving roller between a separation position where the fixing belt driving roller is separated from the fixing belt and a contact position where the fixing belt driving roller is brought into contact with the fixing belt and rotated to rotate the fixing belt; and the control section controls the fourth movement section to move the fixing belt driving roller to the separation position in the printing operation and move the fixing belt driving roller to the contact position when the printing operation is not performed.

Desirably, in the computer-readable recording medium storing a program, the control section controls the fourth movement section such that a rotational speed of the fixing belt when the printing operation is not performed is lower than a rotational speed of the heating roller in the printing operation.

Desirably, in the computer-readable recording medium storing a program, the fixing side member rotates along with rotation of the heating roller in the printing operation.

An image forming apparatus desirably includes the above-mentioned computer-readable recording medium storing a program.

DESCRIPTION OF THE PREFERRED EMBODIMENTS

Figure 1:
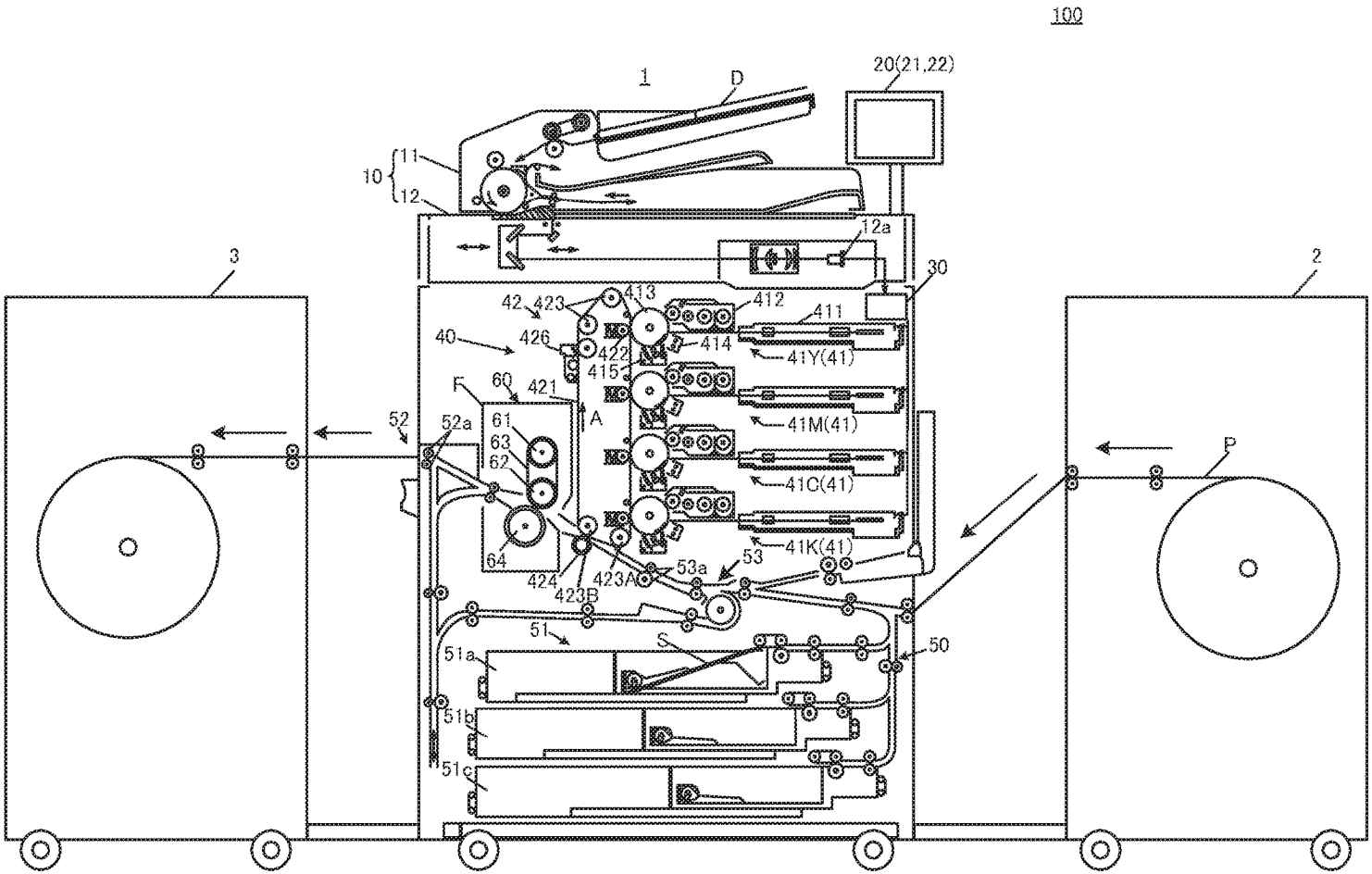
FIG. 1 schematically illustrates a general configuration of an image forming apparatus according to an embodiment.
Figure 2:
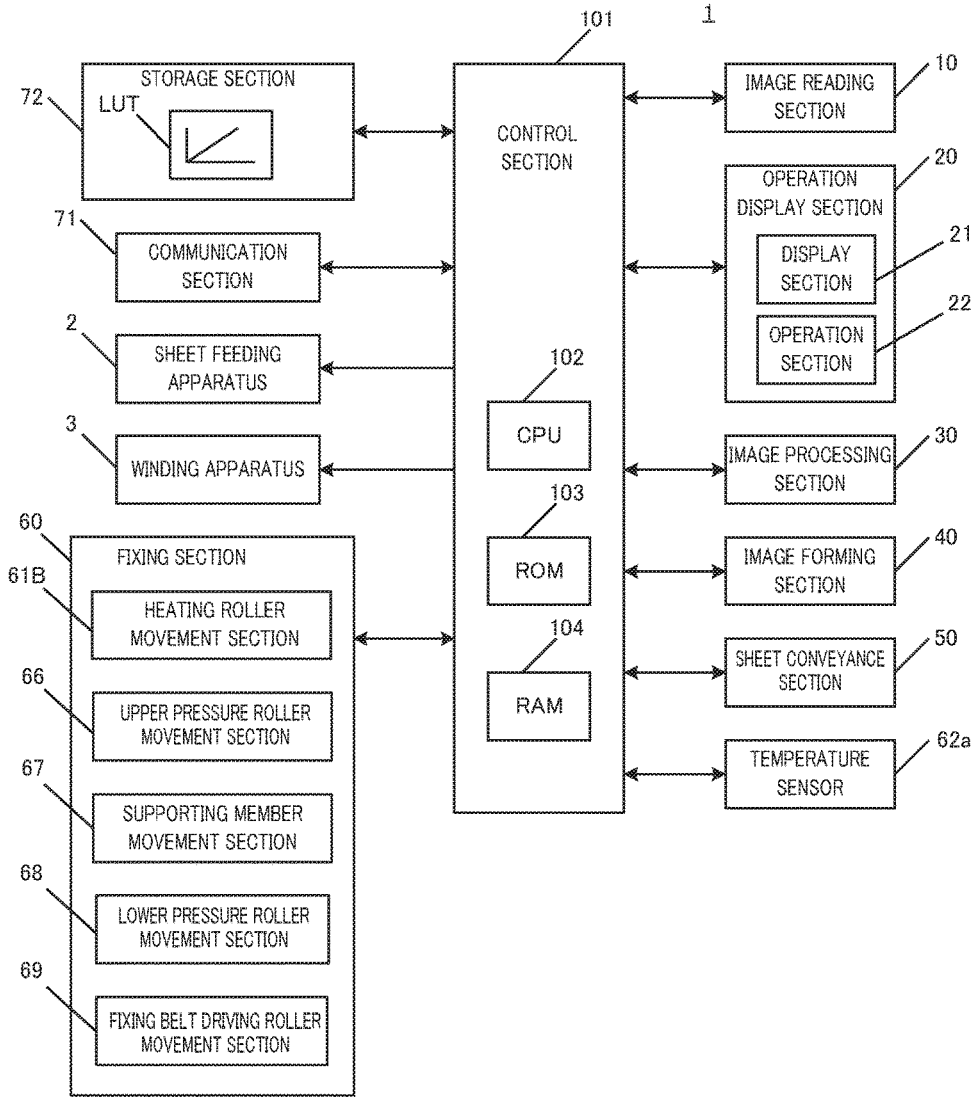
FIG. 2 illustrates a principal part of a control system of the image forming apparatus according to the embodiment.

In the following, an embodiment of the present invention is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment of the present invention. Formation system 100 includes image forming apparatus 1, sheet feeding apparatus 2 and winding apparatus 3, and forms an image on continuous sheet P and cut sheet S which are used as a recording medium. In the following, regarding components commonly used for image formation on both of continuous sheet P and cut sheet S, only the components for image formation on continuous sheet P will be described, and, regarding components different between the case of continuous sheet P and the case of cut sheet S, each of such components will be described.

As illustrated in FIG. 1, image formation system 100 is composed of image forming apparatus 1, sheet feeding apparatus 2 and winding apparatus 3 connected together. Sheet feeding apparatus 2 is disposed on the upstream side of image forming apparatus 1 in the conveyance direction of continuous sheet P (hereinafter referred to also as "sheet conveyance direction"), and winding apparatus 3 is disposed on the downstream side of image forming apparatus 1 in the sheet conveyance direction.

Image forming apparatus 1 is a color-image forming apparatus of an intermediate transfer system using electrophotographic process technology. A longitudinal tandem system is adopted for image forming apparatus 20. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to continuous sheet P fed from sheet feeding apparatus 2, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

Sheet feeding apparatus 2 is an apparatus for feeding continuous sheet P to image forming apparatus 1. As illustrated in FIG. 1, in the housing of sheet feeding apparatus 2, roll-shaped continuous sheet P is wound around a support shaft and is rotatably held. Sheet feeding apparatus 2 conveys, via a plurality of conveyance rollers (such as a delivery roller and a sheet feed roller, for example), continuous sheet P wound around the support shaft to the outside at a constant speed. The sheet feeding operation of sheet feeding apparatus 2 is controlled by control section 101 (see FIG. 2) of image forming apparatus 1. It is to be noted that, in sheet feeding apparatus 2, continuous sheet P may not be held in a roll form, and may be held in a folded state. In addition, while only one continuous sheet P is illustrated in FIG. 1, a plurality of continuous sheets P may be held in the housing of sheet feeding apparatus 2.

As illustrated in FIG. 2, image forming apparatus 1 includes image reading section 10, operation display section 20, image processing section 30, image forming section 40, sheet conveyance section 50, fixing section 60, and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 1 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data transmitted from the external apparatus, and performs control to form an image on continuous sheet P on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 101. Operation section 22 includes various operation keys such as numeric keys and a start key, receives various input operations performed by a user, and outputs operation signals to control section 101.

Image processing section 30 includes a circuit that performs a digital image process suited to initial settings or user settings on the input image data, and the like. For example, image processing section 30 performs tone correction on the basis of tone correction data (tone correction table), under the control of control section 101. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to continuous sheet P is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when continuous sheet P passes through the secondary transfer nip, the toner image on intermediate transfer belt 421 is secondary-transferred to continuous sheet P. To be more specific, a secondary transfer bias is applied to secondary transfer roller 424, and an electric charge of the polarity opposite to the polarity of the toner is applied to the rear side (the side that makes contact with secondary transfer roller 424) of continuous sheet P, whereby the toner image is electrostatically transferred to continuous sheet P. Continuous sheet P on which the toner images have been transferred is conveyed toward fixing section 60.

Belt cleaning device 426 removes transfer residual toner which remains on the surface of intermediate transfer belt 421 after a secondary transfer. A configuration in which a secondary transfer belt is installed in a stretched state in a loop form around a plurality of support rollers including a secondary transfer roller may also be adopted in place of secondary transfer roller 424.

Sheet conveyance section 50 includes sheet feeding section 51, sheet ejection section 52, conveyance path section 53 and the like. Three sheet feed tray units 51*a* to 51*c* included in sheet feeding section 51 store cut sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

Cut sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of cut sheet S fed thereto, and the conveyance timing is adjusted. Then, in image forming section 40, the toner image on intermediate transfer belt 421 is secondary-transferred to one side of cut sheet S at one time, and a fixing process is performed in fixing section 60. Continuous sheet P fed from sheet feeding apparatus 2 to image forming apparatus 1 is conveyed to image forming section 40 through conveyance path section 53. Then, in image forming section 40, the toner image on intermediate transfer belt 421 is secondary-transferred to one side of continuous sheet P at one time, and a fixing process is performed in fixing section 60. Continuous sheet P or cut sheet S on which an image has been formed is ejected out of the image forming apparatus by sheet ejection section 52 including sheet ejection rollers 52*a*.

Winding apparatus 3 is an apparatus for winding up continuous sheet P conveyed from image forming apparatus 1. As illustrated in FIG. 1, in the housing of winding apparatus 3, continuous sheet P is wound around a support shaft and held in a roll form for example.

Fixing section 60 includes heating roller 61, upper pressure roller 62 (which corresponds to "fixing side member" of the embodiment of the present invention), fixing belt 63, lower pressure roller 64 (which corresponds to "back side supporting member" of the embodiment of the present invention), upper pressure roller movement section 66 (which corresponds to "first movement section" of the embodiment of the present invention) and the like.

Fixing section 60 is disposed as a unit in fixing part F. Fixing section 60, and control section 101 which controls fixing section 60 correspond to "fixing device" of the embodiment of the present invention.

Heating roller 61 is a hollow roller member made of a metal material having a high thermal conductivity such as aluminum, and heater 61*a* (heat source)(see FIG. 3) is provided inside the cylindrical body. Heater 61*a* is a halogen heater, and the both end portions of heater 61*a* are fixed to the side plate (not illustrated) of fixing device F. Heating roller 61 is heated with the radiant heat output from heater 61*a* controlled by the power source section (alternating current power source) of the apparatus main body. Control section 101 turns heater 61*a* on and off. In addition, control section 101 controls heating roller movement section 61*b* (see FIG. 2) to rotate and stop heating roller 61.

Figure 3:
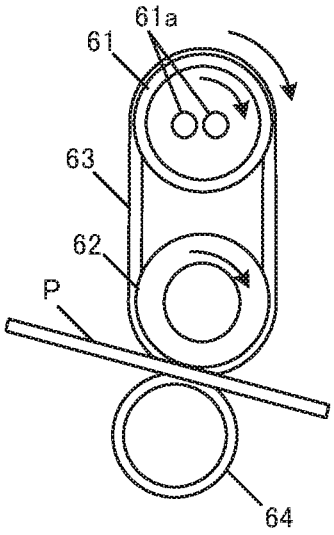
FIG. 3 schematically illustrates the fixing device according to the embodiment.
Figure 4:
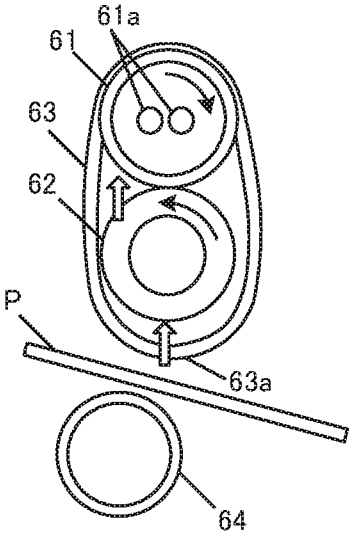
FIG. 4 schematically illustrates the fixing device according to the embodiment.

FIG. 3 schematically illustrates the fixing device in the printing operation, and FIG. 4 schematically illustrates the fixing device in the state where the printing operation is not performed.

Upper pressure roller 62 is rotatably disposed at a position on the fixation surface (the surface on which a toner image is formed) side of continuous sheet P and below heating roller 61. Upper pressure roller 62 is a roller member in which an elastic layer made of silicone rubber is formed on a mandrel of SUS304 or the like. Upper pressure roller 62 makes pressure contact with lower pressure roller 64 with fixing belt 63 therebetween to thereby form a fixing nip. Control section 101 controls upper pressure roller movement section 66 such that upper pressure roller 62 moves between a first pressure contact position where upper pressure roller 62 makes pressure contact with lower pressure roller 64 to form a fixing nip (see FIG. 3), and a second pressure contact position where upper pressure roller 62 makes pressure contact with heating roller 61 (see FIG. 4). That is, upper pressure roller 62 has a configuration capable of separating upper pressure roller 62 from continuous sheet P located at a position of the fixing nip only in the space between heating roller 61 and upper pressure roller 62.

Fixing belt 63 is an endless belt having a multi-layer structure in which an elastic layer and a releasing layer are sequentially stacked on a base layer made of a resin. The elastic layer of fixing belt 63 is formed of an elastic material such as fluorine rubber, silicone rubber, and foaming silicone rubber. The releasing layer is formed of PFA (tetrafluoroethylene perfluoroalkyl vinyl ether copolymer resin), polyimide resin, polyetherimide resin, PES (polyether sulfone resin), or the like. With the releasing layer, releasability to a toner image is ensured.

Fixing belt 63 is wound around upper pressure roller 62 and heating roller 61. When upper pressure roller 62 is moved to the first pressure contact position, fixing belt 63 is supported with a tensile force (tension) exerted by upper pressure roller 62 and heating roller 61. At this time, fixing belt 63 is sandwiched between upper pressure roller 62 and lower pressure roller 64, and heats continuous sheet P which is sandwiched between upper pressure roller 62 and lower pressure roller 64 together with fixing belt 63. On the other hand, when upper pressure roller 62 is moved to the second pressure contact position, the tensile force is released, and fixing belt 63 makes contact with heating roller 61 with only the own weight.

The coefficient of friction of the surface of heating roller 61 on the internal surface of fixing belt 63 is set such that, in the state where fixing belt 63 is in contact with heating roller 61 only with the own weight, fixing belt 63 slips along with rotation of heating roller 61 (the rotation in clockwise direction illustrated in FIG. 4). Such a coefficient of friction is obtained by surface treatment of heating roller 61, coating on heating roller 61 and the like. It is to be noted that the coefficient of friction may be obtained by surface treatment on fixing belt 63 and the like, or may be obtained by surface treatment on both of heating roller 61 and fixing belt 63 and the like.

Lower pressure roller 64 is rotatably disposed on the rear surface (the surface opposite to the fixation surface) side of continuous sheet P. Lower pressure roller 64 is mainly composed of a mandrel and an elastic layer formed on the outer peripheral surface of the mandrel with a bonding layer therebetween.

Next, an exemplary operation of the fixing device according to the present embodiment will be described. Here, the following describes an exemplary operation of the fixing device in which a warming-up operation is executed when the power source is turned on; a standby mode is set after the warming-up operation; a printing operation is executed when a printing request is made in the standby mode; and the standby mode is again set when the printing is completed. The time during which a printing operation is executed corresponds to the phrase "in the printing operation" of the embodiment of the present invention, and the time during which a warming-up operation is executed or a standby mode is set corresponds to the phrase "when the printing operation is not performed" of the embodiment of the present invention.

Before power is switched on, heater 61*a* is in an off state. Accordingly, heating roller 61 is in a cold state. In addition, heating roller 61 is not rotated. Upper pressure roller 62 is located at the second pressure contact position, and is in pressure contact with heating roller 61.

In the warming-up operation, control section 101 turns on heater 61*a*. Accordingly, the temperature of heating roller 61 increases. In addition, control section 101 controls heating roller movement section 61*b* to rotate heating roller 61 in a normal rotation direction (the clockwise direction illustrated with arrow in FIG. 4). Since upper pressure roller 62 is in pressure contact with heating roller 61, the entire surface of upper pressure roller 62 is heated according to the increase of the temperature of heating roller 61 (warming-up of upper pressure roller 62).

In the warming-up operation, the tensile force of fixing belt 63 is in a released state, and fixing belt 63 is in contact with heating roller 61 with only the own weight. In this state, the coefficient of friction of the surface of heating roller 61 on the internal surface of fixing belt 63 is set such that the belt slips along with the rotation of heating roller 61. Consequently, fixing belt 63 does not rotate, and the heat of fixing belt 63 is not transmitted to continuous sheet P.

In the warming-up operation, when it is determined that the temperature of upper pressure roller 62 detected by temperature sensor 62*a* (see FIG. 2) has reached the standby temperature, control section 101 sets heating roller 61 to the standby mode.

In the standby mode, control section 101 continuously rotates heating roller 61, or, intermittently repeats rotation and stop of heating roller 61 to control heating roller movement section 61*b* such that the temperature of upper pressure roller 62 is maintained at a temperature at which a fixation failure is not caused. In this manner, the temperature of upper pressure roller 62 can be maintained at the warming-up state (see FIG. 4).

That is, in the warming-up operation and the standby mode, the heat value of heating roller 61 is used for warming-up of upper pressure roller 62 and maintenance of the warming-up state. Thus, the heat value is not wasted, and stable fixation performance can be achieved without causing temperature drop at the start of the next printing.

Figure 5:
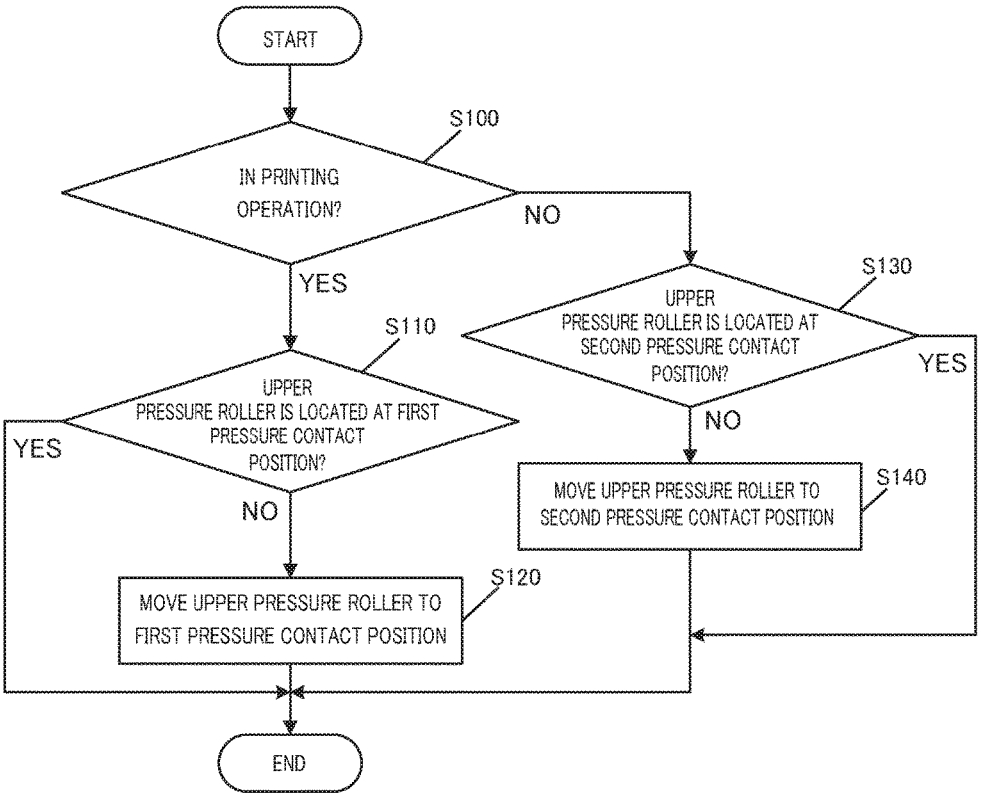
FIG. 5 is a flowchart of an exemplary operation of the fixing device according to the embodiment.

Next, an exemplary operation of fixing device after the warming-up operation is described with reference to FIG. 5. FIG. 5 is a flowchart of an exemplary operation of the fixing device after the warming-up operation.

The process of step S100 is started after the warming-up operation. Control section 101 determines whether a printing operation is performed (step S100).

When control section 101 determines that a printing operation is performed (step S100: YES), control section 101 determines whether upper pressure roller 62 is located at the first pressure contact position (see FIG. 3) (step S110). When control section 101 determines that upper pressure roller 62 is not located at the first pressure contact position (step S110: NO), the process is advanced to step S120. When control section 101 determines that upper pressure roller 62 is located at the first pressure contact position (step S110: YES), the processing of FIG. 5 is terminated.

At step S120, control section 101 controls upper pressure roller movement section 66 to move upper pressure roller 62 from the second pressure contact position (see FIG. 4) to the first pressure contact position. Accordingly, a tensile force is exerted on fixing belt 63, and thus upper pressure roller 62 is driven by the belt. In addition, since fixing belt 63 and continuous sheet P are sandwiched between upper pressure roller 62 and lower pressure roller 64, an unfixed toner image on continuous sheet P is heated and pressed at the fixing nip, and fixed on continuous sheet P.

At step S100, when control section 101 determines that the printing operation is not performed (step S100: NO), control section 101 determines whether upper pressure roller 62 is located at the second pressure contact position (step S130). When it is determined that upper pressure roller 62 is not located at the second pressure contact position (step S130: NO), the process is advanced to step S140. When it is determined that upper pressure roller 62 is located at the second pressure contact position (step S130: YES), the processing of FIG. 5 is terminated.

At step S140, control section 101 controls upper pressure roller movement section 66 to move upper pressure roller 62 from the first pressure contact position to the second pressure contact position. In this manner, upper pressure roller 62 is brought into the warming-up state.

In the fixing device according to the embodiment of the present invention, control section 101 controls upper pressure roller movement section 66 to move upper pressure roller 62 to the first pressure contact position to exert the tensile force on fixing belt 63 in the printing operation, whereas control section 101 controls upper pressure roller movement section 66 to move upper pressure roller 62 to the second pressure contact position to release the tensile force when the printing operation is not performed.

In this manner, by rotating and bringing upper pressure roller 62 into pressure contact with heating roller 61 when the printing operation is not performed, the surface of upper pressure roller 62 can be directly heated and warmed up. Therefore, the heat value is not wasted, and the fixing temperature is not dropped at the start of the next printing, and thus, stable fixation performance can be achieved.

In addition, with the configuration in which upper pressure roller 62 can be separated from continuous sheet P located at a position of the fixing nip only in the space between heating roller 61 and upper pressure roller 62, downsizing can be achieved.

Further, since the tensile force of fixing belt 63 is released when the printing operation is not performed, the stress exerted on fixing belt 63 is small, and durability can be increased.

Further, since upper pressure roller 62 is separated from the position of the fixing nip, continuous sheet P is not damaged by receiving the heat of upper pressure roller 62, so that waste paper is not generated.

Further, the coefficient of friction of heating roller 61 on fixing belt 63 is set such that fixing belt 63 slips along with rotation of heating roller 61 when the printing operation is not performed. Accordingly, fixing belt 63 is not rotated, and thus heat is not transmitted to continuous sheet P, that is, continuous sheet P is not heated. As a result, waste paper is not generated, and it is possible to prevent continuous sheet P from being wasted in the warming-up operation and the standby mode.

(Modification 1)

Figure 6:
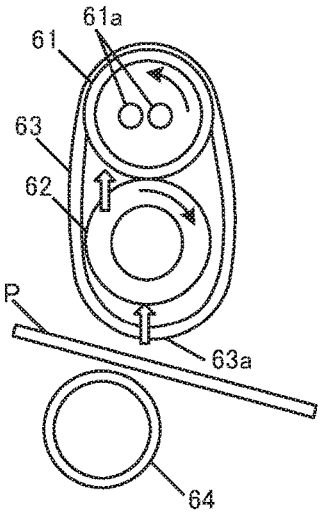
FIG. 6 schematically illustrates a fixing device according to modification 1.

A fixing device according to modification 1 of the present embodiment is described with reference to FIG. 6. In the above-mentioned embodiment, control section 101 controls heating roller movement section 61*b* to rotate heating roller 61 in the same direction (for example, the clockwise direction illustrated in FIG. 3) regardless of whether the printing operation is performed. In addition, the coefficient of friction of the surface of heating roller 61 on the internal surface of fixing belt 63 is set to a small value such that fixing belt 63 slips when heating roller 61 is rotated in the state where the printing operation is not performed and the tensile force of fixing belt 63 is released, and, fixing belt 63 is in contact with heating roller 61 only by the own weight. With this configuration, when the coefficient of friction is excessively small, the driving force from heating roller 61 cannot be sufficiently transmitted to fixing belt 63 in the printing operation. When the coefficient of friction is large, fixing belt 63 does not slip but is rotated when the printing operation is not performed, and the heat of fixing belt 63 is brought closer to continuous sheet P to heat continuous sheet P, and consequently, continuous sheet P may be damaged.

In contrast, in modification 1, control section 101 controls heating roller movement section 61*b* to rotate heating roller 61 in a normal rotation direction (for example, clockwise direction) in the printing operation, while rotating rotate heating roller 61 in the reverse direction (the counterclockwise direction illustrated in FIG. 6) when the printing operation is not performed. In this case, the coefficient of friction of the surface of heating roller 61 on fixing belt 63 is set such that the coefficient of friction is large for rotation of heating roller 61 in the normal rotation direction, and is small for rotation of heating roller 61 in the reverse direction. In this manner, in the printing operation, the driving force from heating roller 61 can be sufficiently transmitted to fixing belt 63 and stable rotation can be ensured, and, when the printing operation is not performed, the heat of fixing belt 63 is not brought closer to continuous sheet P since fixing belt 63 slips on heating roller 61.

Such a coefficient of friction is obtained by surface treatment of heating roller 61, coating on heating roller 61 and the like. It is to be noted that the coefficient of friction may be obtained by surface treatment on fixing belt 63 and the like, or may be obtained by surface treatment on both of heating roller 61 and fixing belt 63 and the like.

(Modification 2)

A fixing device according to modification 2 of the present embodiment is described with reference to FIG. 7. In the above-mentioned embodiment, the coefficient of friction is set such that fixing belt 63 slips when heating roller 61 is rotated in the state where the tensile force of fixing belt 63 is released and fixing belt 63 is in contact with heating roller 61 only with the own weight when the printing operation is not performed.

However, when the temperature is raised by the heating, the circumference of fixing belt 63 is increased due to thermal expansion, and the rigidity (stiffness) is reduced. As a result, at a time point immediately after the printing, lower end portion 63*a* (which corresponds to "slacked portion" of the embodiment of the present invention) of fixing belt 63 comes closer to the position of the fixing nip. As a result, continuous sheet P may be influenced by the heat of fixing belt 63 side. In view of this, it is necessary to intentionally separate lower end portion 63*a* of fixing belt 63 from the position of the fixing nip.

In modification 2, in addition to the configuration of the embodiment, supporting member 65 (see FIG. 7) and supporting member movement section 67 (see FIG. 2) are provided.

Figure 7:
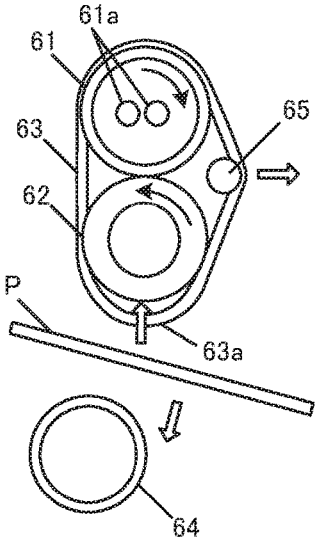
FIG. 7 schematically illustrates a fixing device according to modification 2.

Supporting member movement section 67 (which corresponds to "second movement section" of the embodiment of the present invention) moves supporting member 65 between a near position which is close to the position between heating roller 61 and upper pressure roller 62, and a remote position separated from the near position in a horizontal direction toward the outside of fixing belt 63 (the direction illustrated with the arrow in FIG. 7). When the printing operation is not performed, control section 101 controls upper pressure roller movement section 66 to move upper pressure roller 62 to the second pressure contact position, and controls supporting member movement section 67 to move supporting member 65 to the remote position such that lower end portion 63*a* of fixing belt 63 is moved away from the position of the fixing nip. In this manner, continuous sheet P is not heated by lower end portion 63*a* of fixing belt 63, and waste paper is not generated.

It is to be noted that, as long as lower end portion 63*a* of fixing belt 63 can be moved away to a position where the heat does not have the influence on continuous sheet P, supporting member 65 may be moved until a tensile force is exerted on fixing belt 63. In addition, supporting member 65 may be used as a tension roller of fixing belt 63 in the printing operation, and may be used as a stretching roller which holds the surface of fixing belt 63 at a position close to the upstream side of upper pressure roller 62.

In addition, it is possible to provide a lower pressure roller movement section 68 (which corresponds to "third movement section" of the embodiment of the present invention) which moves lower pressure roller 64 between a nip formation position for forming the fixing nip and a non-nip formation position where the fixing nip is not formed. In this case, control section 101 may control lower pressure roller movement section 68 to move lower pressure roller 64 from the nip formation position to the non-nip formation position (the movement direction is illustrated with the arrow in FIG. 7) when the printing operation is not performed. In the case where continuous printing is performed, lower pressure roller 64 is also heated with the heat value of upper pressure roller 62, and therefore damaging of continuous sheet P can be reduced by moving away not only upper pressure roller 62 but also lower pressure roller 64 from continuous sheet P when the operation is changed from the printing operation to other operations (such as the standby mode).

(Modification 3)

In the above-mentioned embodiment, in the operations other than the printing operation such as the warming-up operation and the standby mode, fixing belt 63 slips when heating roller 61 rotates (see FIG. 4). Accordingly, in fixing belt 63, only the portion which is in contact with heating roller 61 is heated, and other portions are in a cold state. In the printing operation (see FIG. 3), fixing belt 63 is rotated and an unfixed toner image on continuous sheet P is fixed. Here, however, fixing belt 63 has partial temperature difference at the time immediately after the start of printing, and this may result in image defects such as gloss unevenness. For the purpose of preventing image defect, it is necessary to rotate fixing belt 63 so as not to cause partial temperature difference when the printing operation is not performed. In addition, when fixing belt 63 is rotated, the heat of fixing belt 63 may be transmitted to continuous sheet P located at the position of the fixing nip, and continuous sheet P may be heated. Therefore, it is necessary to rotate the fixing belt at a speed at which continuous sheet P does not receive the heat of fixing belt 63.

Figure 8:
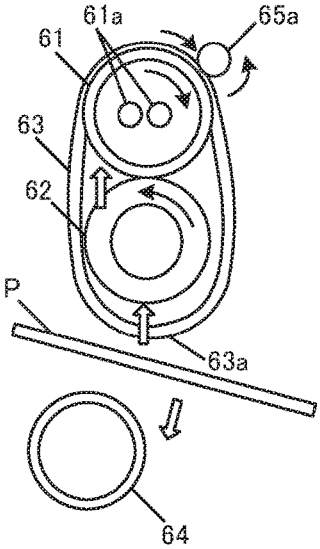
FIG. 8 schematically illustrates a fixing device according to modification 3.

A fixing device according to modification 3 of the present embodiment is described with reference to FIG. 8. In modification 3, in addition to the configurations of the embodiment, belt roller 65*a* and fixing belt driving roller movement section 69 (see FIG. 2) are provided.

Fixing belt driving roller movement section 69 (which corresponds to "fourth movement section" of the embodiment of the present invention) moves belt roller 65*a* between a separation position where belt roller 65*a* is separated from fixing belt 63, and a contact position where belt roller 65*a* is brought into contact with fixing belt 63 and rotated to rotate fixing belt 63. Control section 101 controls fixing belt driving roller movement section 69 to move belt roller 65*a* to the separation position in the printing operation, and move belt roller 65*a* to the contact position when the printing operation is not performed. It is to be noted that the external surface of fixing belt 63 includes an image region relating to fixation of a toner image, and a non-image region. In this case, belt roller 65*a* may be an axis roller which makes contact with the entire surface (the image region and the non-image region) of fixing belt 63, or may make contact with the non-image region of fixing belt 63.

Since fixing belt 63 can be independently rotated by bringing belt roller 65*a* into contact with fixing belt 63 while rotating the rotating belt roller 65*a* when the printing operation is not performed, partial temperature difference can be prevented, and image defects such as gloss unevenness due to partially heated fixing belt 63 can be suppressed. Further, when fixing belt 63 heated by heating roller 61 is rotated at a speed at which the heat can be released until reaching the fixing nip, continuous sheet P located at the position of the fixing nip is not heated.

In the operations other than the printing operation such as the warming-up operation and the standby mode, the surface of upper pressure roller 62 is required to be uniformly and efficiently heated, and therefore the rotational speed of heating roller 61 is required to be set to a high speed. On the other hand, the rotational speed of fixing belt 63 is required to be set to a low speed so that the heat is released until fixing belt 63 reaches the fixing nip and that the temperature of the fixing nip is not raised by the heat of fixing belt 63. In view of this, the coefficient of friction of belt roller 65*a* on the external surface of fixing belt 63 is set to a value larger than the coefficient of friction of heating roller 61 on the internal surface of fixing belt 63. In this manner, the rotational speed of driven heating roller 61 and the rotational speed of fixing belt 63 can be varied, and thus, the rotational speed (circumferential velocity) of heating roller 61 can be set to a speed higher than the rotational speed (circumferential velocity) of fixing belt 63 when the printing operation is not performed. When the printing operation is not performed, fixing belt 63 slips on heating roller 61.

In addition, in the printing operation, fixing belt 63 is required to be rotated at a predetermined speed to fix an unfixed toner image on continuous sheet P. In contrast, when the printing operation is not performed, the rotational speed of fixing belt 63 is required to be reduced as described above. In view of this, when the printing operation is not performed, control section 101 controls fixing belt driving roller movement section 69 such that the rotational speed of fixing belt 63 is lower than the rotational speed of fixing belt 63 of the printing operation. In this manner, stable fixation performance can be achieved, and in addition, continuous sheet P located at the position of the fixing nip is not heated by fixing belt 63, so that waste paper is not generated.

While continuous sheet P is used in the above-mentioned embodiment, the present invention is not limited to this. For example, in the case where cut sheet S is used, control section 101 may control upper pressure roller movement section 66 to move upper pressure roller 62 to the second pressure contact position to bring upper pressure roller 62 into pressure contact with heating roller 61 in the operations other than the printing operation such as the warming-up operation and the standby mode. With this configuration, the heat of heating roller 61 is mainly used for warming-up of upper pressure roller 62 and for maintenance of the warming-up state, and stable fixation performance can be achieved without wasting the heat value.

In addition, while upper pressure roller 62 is described in the above-mentioned embodiment as a component corresponding to the fixing side member of the embodiment of the present invention, the present invention is not limited to this. For example, the fixing side member may be a fixation pad composed of an elastic body such as silicone rubber and fluorine rubber, or heat-resistant resin, metal and the like. The surface of the fixation pad which makes contact with the fixing belt may be coated with a layer having a high slidability. In addition, it suffices that control section 101 controls a movement section (not illustrated) to move the fixation pad in the direction of a back side supporting member (lower pressure roller) in the printing operation so as to form a fixing nip with the back side supporting member, and, to move the fixation pad in the direction of the heating roller to bring the fixation pad into pressure contact with the heating roller when the printing operation is not performed.

In addition, the present invention is applicable to, for example, a computer-readable recording medium storing a program including a step of bringing the fixing side member into pressure contact with the back side supporting member with fixing belt 63 therebetween by moving the fixing side member to the first pressure contact position in the printing operation; and a step of bringing the fixing side member into pressure contact with heating roller 61 by moving the fixing side member to the second pressure contact position when the printing operation is not performed.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

REFERENCE SIGNS LIST

60 Fixing section
61 Heating roller
61*a* Heater
62 Upper pressure roller
63 Fixing belt
64 Lower pressure roller
65 Supporting member
65*a* Fixing belt driving roller
66 Upper pressure roller movement section
67 Supporting member movement section
68 Lower pressure roller movement section

69 Fixing belt driving roller movement section
101 Control section

What is claimed is:

1. A fixing device comprising:

a fixing side member disposed on a fixing side of a recording medium on which a toner image is formed;

a fixing belt wound around the fixing side member;

a back side supporting member configured to form a fixing nip for conveying the recording medium in a tightly sandwiching manner in a state where the back side supporting member is in pressure contact with the fixing side member with the fixing belt therebetween;

a heating roller configured to heat the fixing belt from inside, the heating roller being rotatable;

a first movement section configured to move the fixing side member between a first pressure contact position where the fixing side member is brought into pressure contact with the back side supporting member with the fixing belt therebetween, and a second pressure contact position where the fixing side member is brought into pressure contact with the heating roller; and a control section configured to control the first movement section to move the fixing side member to the first pressure contact position in a printing operation, and move the fixing side member to the second pressure contact position when the printing operation is not performed.

2. The fixing device according to claim 1, wherein the heating roller is configured such that the fixing belt rotates along with rotation of the heating roller when the heating roller rotates in the printing operation, and that, when the printing operation is not performed, the fixing belt slips on the heating roller which is rotated.

3. The fixing device according to claim 2, wherein a coefficient of friction of the heating roller on the fixing belt is set such that the fixing belt rotates along with the rotation of the heating roller in a first direction in the printing operation, and that the fixing belt slips on the heating roller which is rotated in a second direction opposite to the first direction when the printing operation is not performed.

4. The fixing device according to claim 1 further comprising:

a supporting member configured to support the fixing belt from inside; and a second movement section configured to move the supporting member, wherein, when the printing operation is not performed, the control section controls the second movement section to move the supporting member in a direction in which a slacked portion of the fixing belt is separated from the fixing nip, the slacked portion of the fixing belt being a portion slacked by movement of the fixing side member to the second pressure contact position in comparison with a state where the printing operation is performed.

5. The fixing device according to claim 4 further comprising a third movement section configured to move the back side supporting member between a nip formation position where the fixing nip is formed and a non-nip formation position where the fixing nip is not formed, wherein the control section controls the third movement section to move the back side supporting member to the nip formation position in the printing operation and to move the back side supporting member to the non-nip formation position when the printing operation is not performed.

6. The fixing device according to claim 1, wherein the recording medium is a continuous sheet.

7. The fixing device according to claim 1 further comprising:

a fixing belt driving roller; and a fourth movement section configured to move the fixing belt driving roller between a separation position where the fixing belt driving roller is separated from the fixing belt and a contact position where the fixing belt driving roller is brought into contact with the fixing belt and rotated to rotate the fixing belt, wherein the control section controls the fourth movement section to move the fixing belt driving roller to the separation position in the printing operation and move the fixing belt driving roller to the contact position when the printing operation is not performed.

8. The fixing device according to claim 7, wherein the control section controls the fourth movement section such that a rotational speed of the fixing belt when the printing operation is not performed is lower than a rotational speed of the heating roller in the printing operation.

9. The fixing device according to claim 1, wherein the fixing side member rotates along with rotation of the heating roller in the printing operation.

10. An image forming apparatus comprising the fixing device according to claim 1.

11. A non-transitory computer-readable recording medium storing a program of a fixing device, the fixing device including:

a fixing side member disposed on a fixing side of a recording medium on which a toner image is formed;

a fixing belt wound around the fixing side member;

a back side supporting member configured to form a fixing nip for conveying the recording medium in a tightly sandwiching manner in a state where the back side supporting member is in pressure contact with the fixing side member with the fixing belt therebetween;

a heating roller configured to heat the fixing belt from inside, the heating roller being rotatable; and a first movement section configured to move the fixing side member between a first pressure contact position where the fixing side member is brought into pressure contact with the back side supporting member with the fixing belt therebetween, and a second pressure contact position where the fixing side member is brought into pressure contact with the heating roller, the program including instructions executable by the first movement section for:

moving the fixing side member to the first pressure contact position to bring the fixing side member into pressure contact with the back side supporting member with the fixing belt therebetween in the printing operation, and moving the fixing side member to the second pressure contact position to bring the fixing side member into pressure contact with the heating roller when the printing operation is not performed.

12. The non-transitory computer-readable recording medium storing a program according to claim 11, wherein the heating roller is configured such that the fixing belt rotates along with rotation of the heating roller when the heating roller rotates in the printing operation, and that, when the printing operation is not performed, the fixing belt slips on the heating roller which is rotated.

13. The non-transitory computer-readable recording medium storing a program according to claim 12, wherein a coefficient of friction of the heating roller on the fixing belt is set such that the fixing belt rotates along with the rotation of the heating roller in a first direction in the printing operation, and that the fixing belt slips on the heating roller which is rotated in a second direction opposite to the first direction when the printing operation is not performed.

14. The non-transitory computer-readable recording medium storing a program according to claim 11, wherein the fixing device further includes:

a supporting member configured to support the fixing belt from inside; and a second movement section configured to move the supporting member, and, when the printing operation is not performed, the control section controls the second movement section to move the supporting member in a direction in which a slacked portion of the fixing belt is separated from the fixing nip, the slacked portion of the fixing belt being a portion slacked by movement of the fixing side member to the second pressure contact position in comparison with a state where the printing operation is performed.

15. The non-transitory computer-readable recording medium storing a program according to claim 14, wherein:

the fixing device further includes a third movement section configured to move the back side supporting member between a nip formation position where the fixing nip is formed and a non-nip formation position where the fixing nip is not formed; and the control section controls the third movement section to move the back side supporting member to the nip formation position in the printing operation and to move the back side supporting member to the non-nip formation position when the printing operation is not performed.

16. The non-transitory computer-readable recording medium storing a program according to claim 11, wherein the recording medium is a continuous sheet.

17. The non-transitory computer-readable recording medium storing a program according to claim 11, wherein:

the fixing device further includes a fixing belt driving roller, and a fourth movement section configured to move the fixing belt driving roller between a separation position where the fixing belt driving roller is separated from the fixing belt and a contact position where the fixing belt driving roller is brought into contact with the fixing belt and rotated to rotate the fixing belt; and the control section controls the fourth movement section to move the fixing belt driving roller to the separation position in the printing operation and move the fixing belt driving roller to the contact position when the printing operation is not performed.

18. The non-transitory computer-readable recording medium storing a program according to claim 17, wherein the control section controls the fourth movement section such that a rotational speed of the fixing belt when the printing operation is not performed is lower than a rotational speed of the heating roller in the printing operation.

19. The non-transitory computer-readable recording medium storing a program according to claim 11, wherein the fixing side member rotates along with rotation of the heating roller in the printing operation.

20. An image forming apparatus comprising the non-transitory computer-readable recording medium storing a program according to claim 11.

* * * * *